US006260304B1

(12) United States Patent
Groeneveld

(10) Patent No.: US 6,260,304 B1
(45) Date of Patent: Jul. 17, 2001

(54) DOOR STRUCTURE

(75) Inventor: Dirk Hugo Groeneveld, Ridderkerk (NL)

(73) Assignee: Beheermaatschappij H.D. Groeneveld B.V. (NL)

( * ) Notice: Subject to any disclaimer, the term of this patent is extended or adjusted under 35 U.S.C. 154(b) by 0 days.

(21) Appl. No.: 09/402,211

(22) PCT Filed: Apr. 1, 1998

(86) PCT No.: PCT/NL98/00178

§ 371 Date: Feb. 29, 2000

§ 102(e) Date: Feb. 29, 2000

(87) PCT Pub. No.: WO98/44228

PCT Pub. Date: Oct. 8, 1998

(30) Foreign Application Priority Data

Apr. 1, 1997 (NL) ..... 1005683

(51) Int. Cl.[7] ..... E05C 9/00
(52) U.S. Cl. ..... 49/395; 292/4
(58) Field of Search ..... 49/394, 395, 402, 49/503; 292/4, 32, 36, 304, 256.5, 257

(56) References Cited

U.S. PATENT DOCUMENTS

| | | | | |
|---|---|---|---|---|
| 2,511,268 | | 6/1950 | Schiff | 114/117 |
| 3,180,303 | * | 4/1965 | Hamilton | 292/256.5 X |
| 4,435,921 | | 3/1984 | Marin | 49/395 |
| 4,527,760 | | 7/1985 | Salacuse | 248/108 |
| 4,971,369 | * | 11/1990 | Jean | 49/395 X |
| 5,086,587 | | 2/1992 | Andrews | 49/395 |
| 5,129,693 | | 7/1992 | Schmitt | 292/300 |
| 5,199,369 | | 4/1993 | Meyer et al. | 114/117 |
| 6,101,764 | * | 8/2000 | Guy-Paul | 49/395 |

FOREIGN PATENT DOCUMENTS

| | | |
|---|---|---|
| 3341544 | 6/1985 | (DE) . |
| 0552505 | 7/1993 | (EP) . |
| 00895 | 1/1913 | (GB) . |
| 1013693 | 12/1965 | (GB) . |
| 2181777 | 4/1987 | (GB) . |
| 2195958 | 4/1988 | (GB) . |
| 2224072 | 4/1990 | (GB) . |

* cited by examiner

*Primary Examiner*—Jerry Redman
(74) *Attorney, Agent, or Firm*—Webb Ziesenheim Logsdon Orkin & Hanson, P.C.

(57) ABSTRACT

A door structure comprises: a first plate serving as fixed frame with an opening enclosed by a peripheral edge; and a door connected pivotally to this first plate by at least one hinge construction such that with its peripheral zone the door can co-act sealingly with said peripheral edge; which first plate carries a number of peripherally arranged clamps, which clamps are simultaneously rotatable by a collective operating mechanism with an operating handle and through rotation can co-act with the peripheral zones of corresponding non-round continuous holes in the door, which peripheral zones have for each clamp a contact surface inclining relative to the main plane of the door structure in the closed situation, which continuous holes have a form such that a clamp can pas therethrough. The door structure has the characteristic that the door comprises a second plate which is strengthened with at least one beam welded to this plate and extending between two clamps situated on either side of the door; the clamps are arranged symmetrically pairwise on rotation shafts; the continuous holes in the door are correspondingly formed slotted holes; each peripheral zone of a continuous hole in the door has two substantially symmeticaly located, inclining clamp contact surfaces.

10 Claims, 5 Drawing Sheets

DOOR STRUCTURE

BACKGROUND OF THE INVENTION

1. Field of the Invention

This invention relates to door structures.

2. Background of the Prior Art

A known door structure includes:

a first plate serving as fixed frame with an opening enclosed by a peripheral edge; and a door connected pivotally to this first plate by at least one hinge construction such that with its peripheral zone the door can co-act sealingly with said peripheral edge;

which first plate carries a number of peripherally arranged clamps, which clamps are simultaneously rotatable by a collective operating mechanism with an operating handle and through rotation can co-act with the peripheral zones of corresponding non-round continuous holes in the door, which peripheral zones have for each clamp a contact surface inclining relative to the main plane of the door structure in the closed situation, which continuous holes have a form such that a clamp can pass therethrough.

The known door structure is used for instance in explosion-sensitive conditions, such as for instance in the extraction of fossil fuel, as well as for military applications, for instance on board military vessels.

SUMMARY OF THE INVENTION

It is an object of the invention to provide a door structure which meets very high mechanical requirements and is nevertheless relatively light. The door according to the invention must be to a great extent fire- and explosion-proof. The explosion resistance must also be guaranteed if the door can be loaded in an explosion by a pressure wave which has a tendency to open a closed door.

With a view to the above stated objectives, the invention generally provides a door structure of the described type which has the feature that the door comprises a second plate which is strengthened with at least one beam welded to this plate and extending between two clamps situated on either side of the door;

the clamps are arranged symmetrically pairwise on rotation shafts;

the continuous holes in the door are correspondingly formed slotted holes;

each peripheral zone of a continuous hole in the door has two substantially symmetrically located, inclining clamp contact surfaces.

The at least one beam increases the bending stiffness of the plate. Should it be wished to achieve the same increased bending stiffness by increasing the plate thickness, the weight of the door would become considerably greater.

The two clamps arranged symmetrically in relation to each associated rotation shaft ensure a symmetrical load on said rotation shaft in the case of tensile strain. In contrast to usual clamps, there need hereby be no fear of bending of the rotation shaft in for instance explosion conditions. Such a known bending can result in a tightened clamp springing open. Partly for this reason the explosion resistance leaves something to be desired in known door structures.

A specific embodiment has the special feature that the door is generally elongate, the hinge construction extends in longitudinal direction and the or each strengthening beam extends in transverse direction. It is noted here that the strengthening beams are preferably arranged in a regularly distributed pattern.

In the case of a door whereof the peripheral zone is provided in the usual manner with a peripheral edge extending transversely of the main plane, strengthening beams can be omitted in the area of the end edges. The placing of the beams can then be limited to the middle zone of the door.

A preferred embodiment has the special feature that the second plate is substantially flat and the beam has a U-shaped profile, which beam is welded substantially wholly to this plate with the free end edges of the U. Of fundamental importance is that the beam contributes essentially over its whole length to the bending stiffness of the second plate. In this respect it is necessary that the connection between the U-beam and the plate is not brought about for instance by means of screws or spot welds but by a full welding of the free end edges of the U-profile fixedly to the plate.

In order to achieve the best possible explosion resistance, all potential passages must be blocked as effectively as possible. In this respect an advantageous embodiment can have the special feature that round the rotation shaft of the clamp is situated a filler piece which fits into the corresponding hole in the door.

In known door constructions is it usual for a continuous hole for a clamp to debouch freely into the opening present in the first plate. In the case of explosion load a bending of the door can hereby result such that the clamps leave the continuous holes via said debouchments. A variant of the structure according to the invention which does not have this drawback has the special feature that each continuous hole in the first door is wholly enclosed by material.

The door structure according to the invention is preferably embodied such that the clamps and the associated holes are placed symmetrically.

A preferred embodiment has the further special feature that the door structure consists substantially of metal, for instance steel.

The term "substantially" is understood to mean that the door construction may also comprise non-dominant components of a different composition. A door construction can for instance comprise thermal insulation material such as mineral wool. In addition, appropriate parts are generally provided with anticorrosive and protective coatings, while sealing means can for instance consist of rubber-like materials.

A specific choice for the door structure according to the invention entails the second plate consisting of steel plate with a thickness of 3–10 mm, in particular about 5 mm.

Another choice consists of the beam having a wall thickness of 2–8 mm, in particular about 4 mm, and consisting of steel with high yield point, for instance QSTE 420 with a yield point of ≧350 kPa.

A particular embodiment is further characterized by a neoprene rubber sealing ring which seals the door relative to the first plate in closed situation.

BRIEF DESCRIPTION OF THE DRAWINGS

The invention will now be elucidated with reference to the annexed drawings. In the drawings.

DESCRIPTION OF THE PREFERRED EMBODIMENTS

Figure 1:
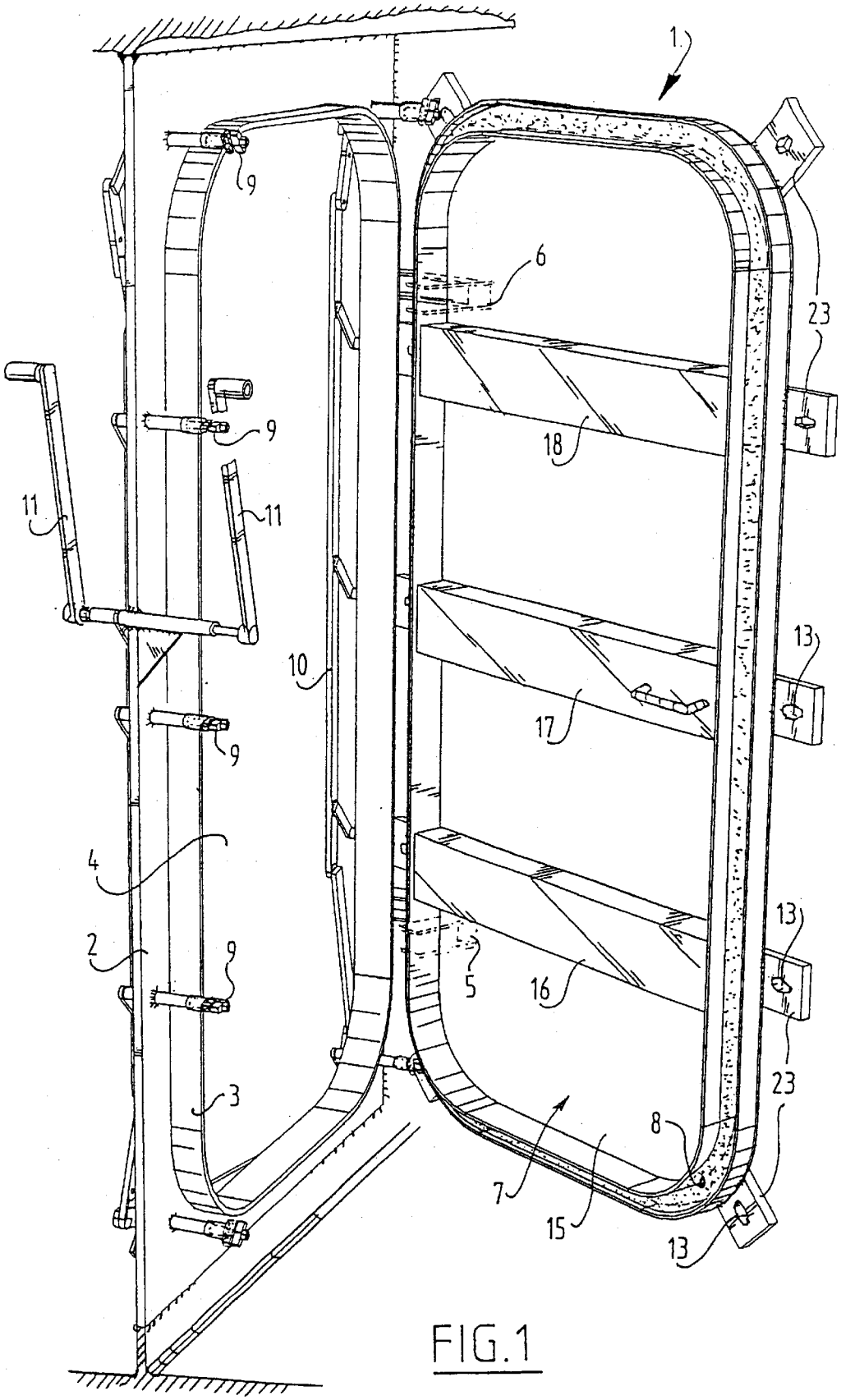
FIG. 1 shows a perspective view of a door structure according to the invention.

The figures shows a door structure 1. This door structure 1 according to the invention comprises a first plate 2 serving as fixed frame with an opening 4 enclosed by a peripheral edge 3 and a door 7 pivotally connected to this first plate 2 by at least one hinge construction 5, 6 such that with its peripheral zone 8 door 7 can co-act sealingly with said peripheral edge 3, which first plate 2 carries in this embodiment ten peripherally arranged clamps 9, which clamps 9 are simultaneously rotatable by a collective operating mechanism 10 with an operating handle 11 and can co-act through rotation with peripheral zones 12 of corresponding non-round continuous holes 13 in door 7, which peripheral zones 12 have for each clamp 9 a contact surface 14 inclining relative to the main plane of door structure 1 in the closed situation, which continuous holes 13 have a form such that a clamp 9 can pass therethrough. Door 7 comprises a second plate 15 which is strengthened in this embodiment with three beams 16, 17, 18 which are welded to this plate 15 and which extend between two clamps situated on either side of the door. Clamps 9 are constructed such that they each consist of two sub-clamps, designated for instance 9*a* and 9*b* in FIG. 4, which are arranged symmetrically pairwise on a rotation shaft 16. The continuous holes 13 in the door are slotted holes, the form of which by and large corresponds with the form of clamps 9, and are so much larger that the clamps can pass through the holes. Each peripheral zone 12 of a continuous hole in door 7 has two substantially symmetrically located, inclining clamp contact surfaces 14*a*, 14*b*. It is noted that the angle at which the inclining clamp contact surfaces 14*a*, 14*b* extend can be freely chosen within certain limits. What is essential is that clamps 9*a*, 9*b* can be placed in wedging co-action with the inclining surfaces 14*a*, 14*b* in question. In this respect attention is drawn to the fact that various function modifications are possible. The clamps themselves can for instance be provided with inclining surfaces co-acting with corresponding non-inclining elevations. By rotating the clamps the same operation is then obtained, i.e. by displacing handles 11 a rotation of the clamps takes place such that owing to the inclining contact surfaces a slight swinging of the door takes place relative to the fixed frame, whereby the desired clamping can be ensured. It is further noted that the clamps can be arranged on the door, in which case the continuous holes and the associated contact surfaces in the zones around the holes form part of the fixed frame.

Door 7 is generally elongate, the common axis of hinges 5, 6 extends in vertical longitudinal direction and strenghtening beams 16, 17, 18 extend in horizontal transverse direction.

The second plate 15 is substantially flat and each beam has a U-shaped profile and is welded substantially wholly to this plate 15 with its free edges 19.

FIGS. 3, 4, 5 and 6 show clearly that around the rotation shaft 16 of a clamp 9 is situated a filler piece 20 fitting into the corresponding hole in door 7. This filler piece can be of any suitable material. Filler piece 20 can for instance be manufactured from metal, but a suitable plastic can also be considered. In respect of the possible calamities for which the door structure according to the invention is designed, a plastic can be of a type which degenerates at high temperature and thereby acquires a hard and more or less foamed structure. This ensures the best possible gastight sealing. In this respect a metal plate 21 is also added to the filler piece. As the figures clearly show, this metal plate 21, which of course does not necessarily have to be present, improves the sealing of the closed door structure.

Figure 2:
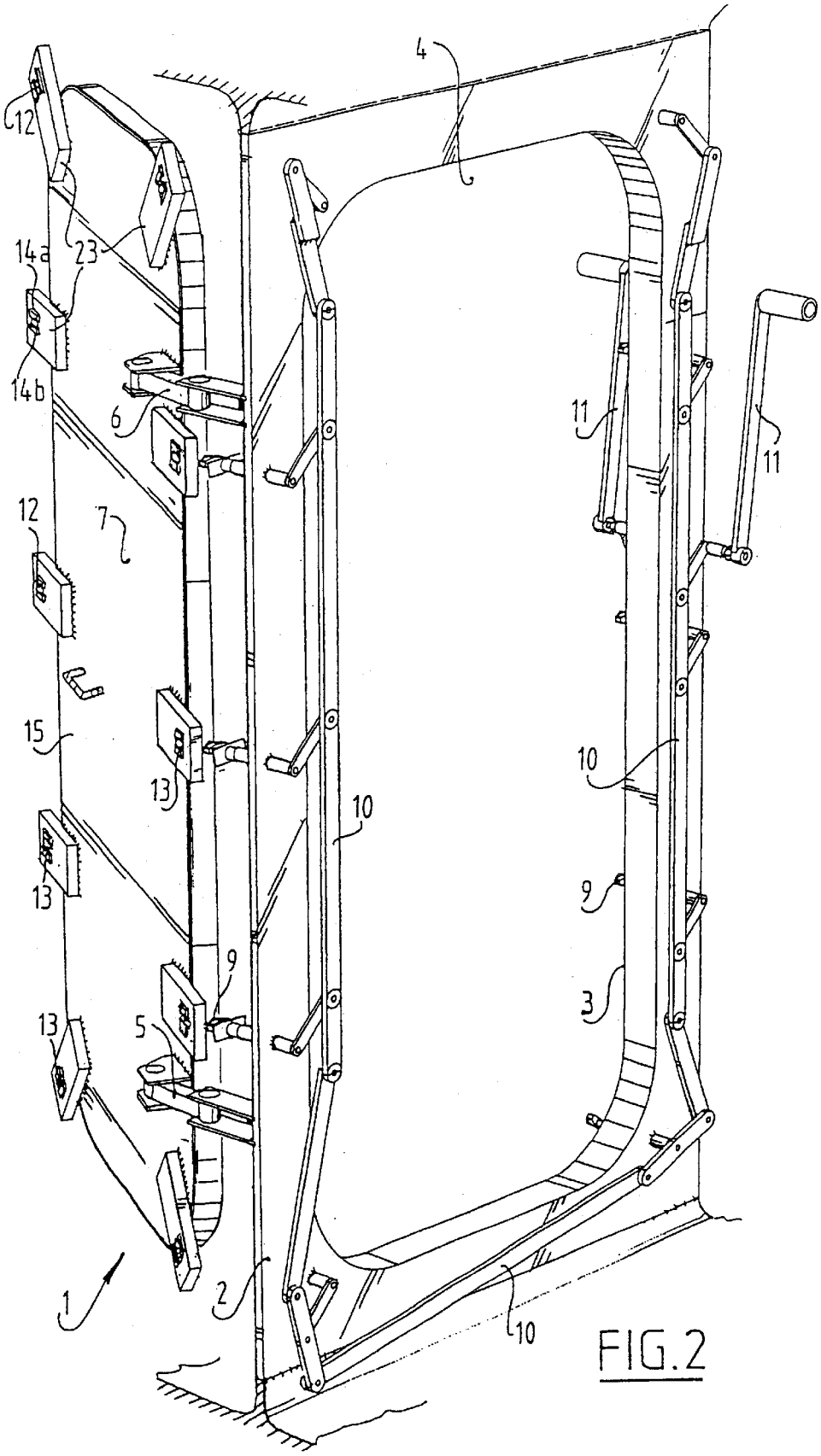
FIG. 2 shows a perspective view of the door structure according to FIG. 1 from the other side.

In usual structures continuous holes consist of two separate lips placed at a mutual distance. For the sake of optimum strength and integrity, also in the case of calamities, according to the invention each continuous hole 13 in door 7 is preferably wholly enclosed by material. Clamps 9 and the associated continuous holes 13 are, as FIGS. 1 and 2 show clearly, placed symmetrically relative to the axis of symmetry of the door structure.

The entire door structure 1 preferably consists substantially of metal, for instance steel.

The second plate 15 preferably consists of plate steel with a thickness of 3–10 mm, in particular about 5 mm.

Each beam 16, 17, 18 preferably has a wall thickness of 2–8 mm, in particular 4 mm, and preferably consists of steel with a high yield point, for instance QSTE 420 with a yield point of ≧350 kPa.

The peripheral zone 8 of the door preferably has a sealing ring 21 consisting of neoprene rubber which seals door 7 relative to peripheral edge 3 in the closed situation.

Figure 3:
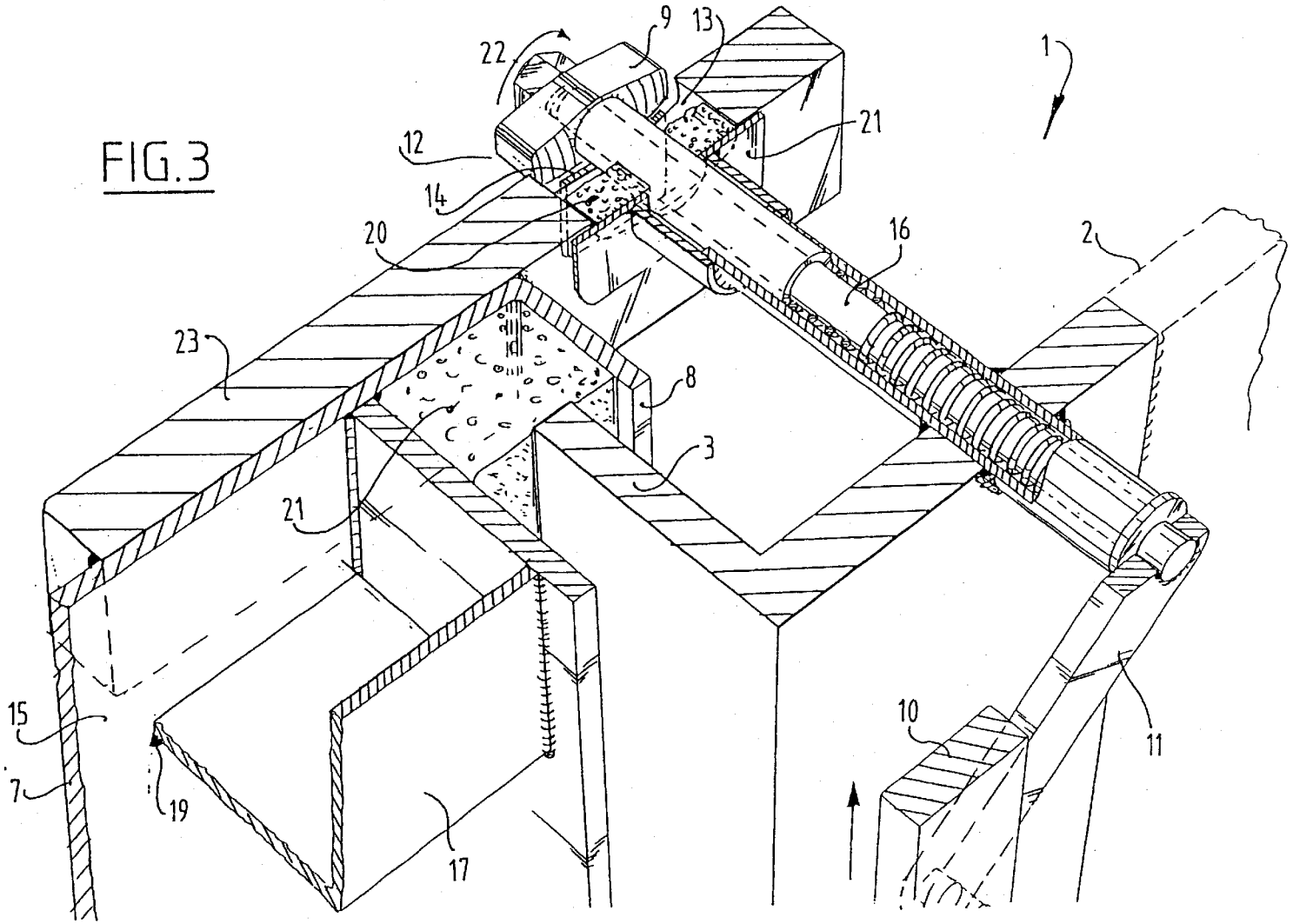
FIG. 3 shows on larger scale a partly broken-away perspective view of a clamp.

FIG. 3 clearly shows the manner in which peripheral edge 3 can co-act sealingly with neoprene rubber sealing ring 21.

In the situation shown in FIG. 3, door 7 is closed from the open position shown in FIGS. 1 and 2. Clamp 9 is passed through continuous hole 13. In this situation the door can still be freely opened. By rotating shaft 16 by operating an operating handle 11 a rotation according to arrow 22 takes place, whereby the more or less cylindrically formed contact surfaces 23*a* and 23*b* come into clamping contact with the respective contact surfaces 14*a* and 14*b*. The situation obtained hereby is shown in FIG. 5.

Figure 5:
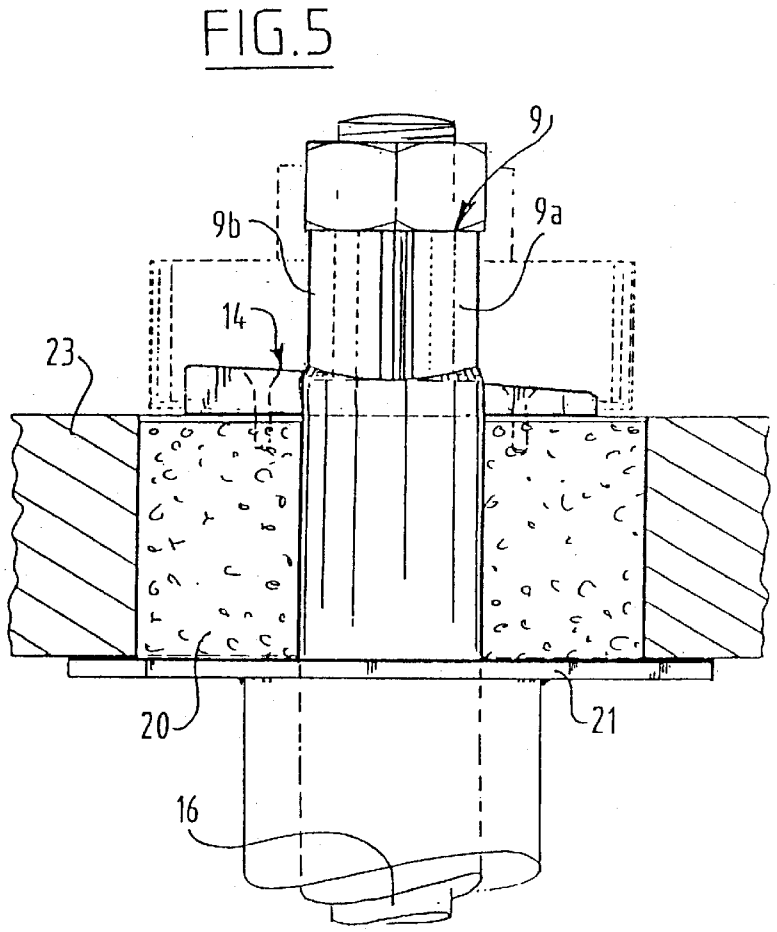
FIG. 5 is a longitudinal section through the clamp according to FIG. 4.

FIG. 5 shows in broken lines the free situation and in full lines the closed situation of the door structure.

Contact surfaces 14, 14*a*, 14*b* can form an integral part of the separate elements 23 which are welded to plate 7 and have the continuous holes 13, but can also be embodied as protrusions separately arranged on these elements 23.

Figure 4:
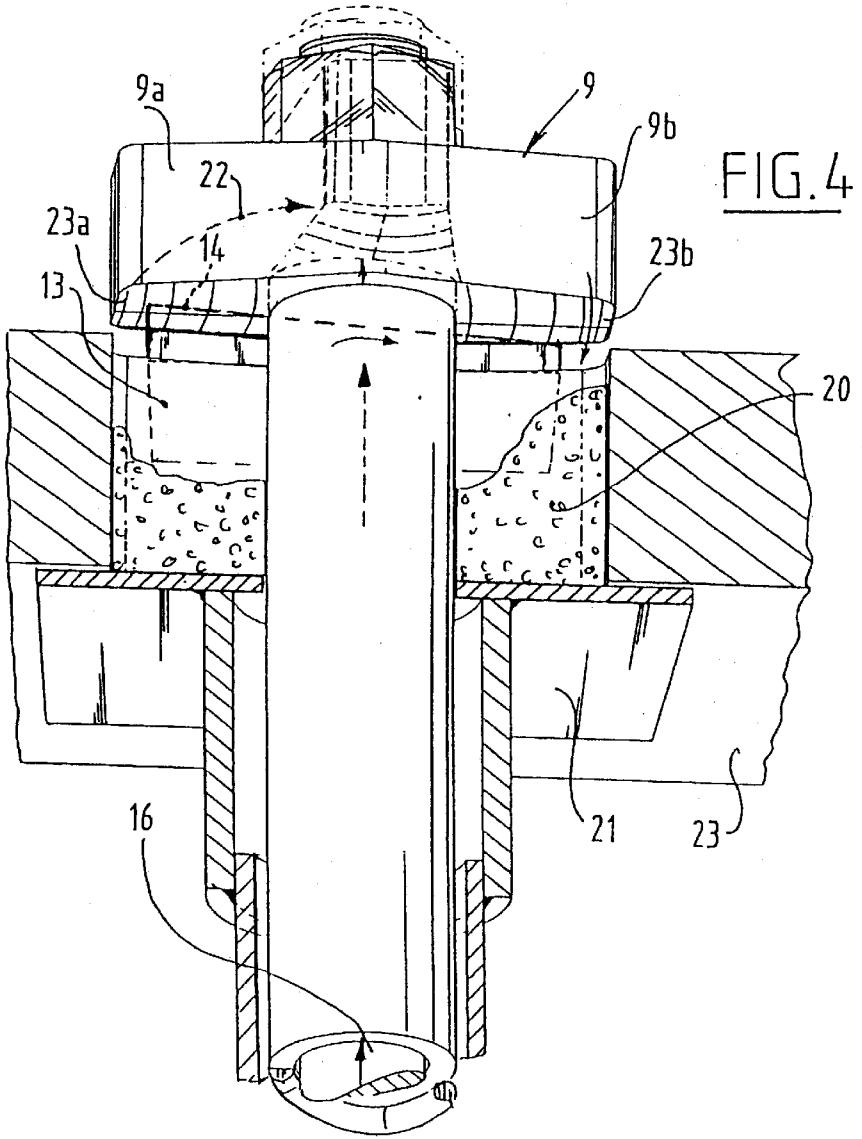
FIG. 4 is a partly broken-away perspective view on enlarged scale of the clamp according to detail IV of FIG. 3.
Figure 6:
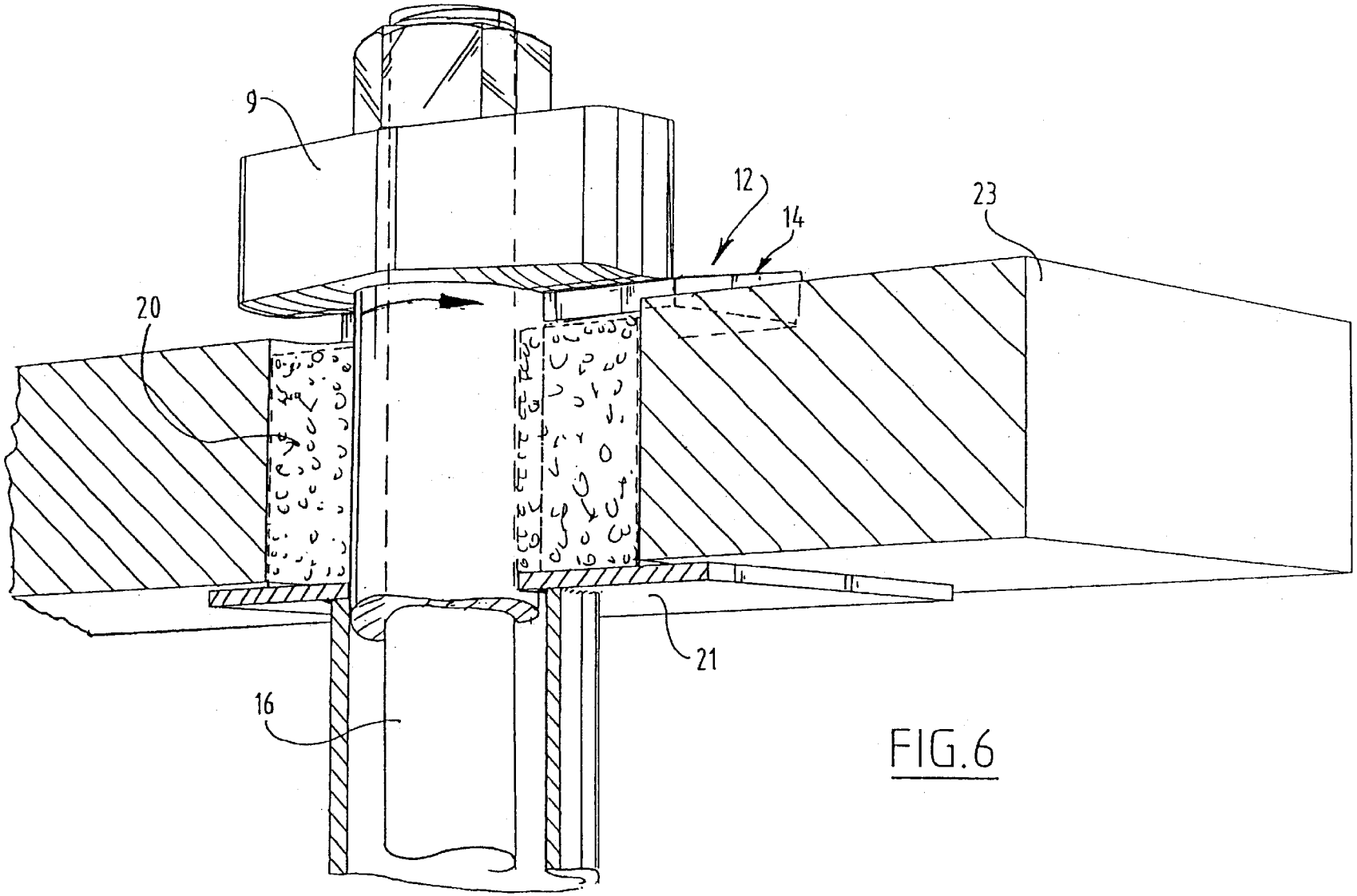
FIG. 6 shows the clamp according to FIG. 4 in an alternative embodiment on still further enlarged scale.

It is noted that the angle of inclination of contact surfaces 14 in FIGS. 4 and 5 differs from this angle in FIG. 6.

What is claimed is:

1. A door structure, comprising:

a first plate serving as fixed frame with an opening enclosed by a peripheral edge; and a door connected pivotally to said first plate by at least one hinge construction such that with its peripheral zone the door can co-act sealingly with said peripheral edge;

with said first plate carrying a number of peripherally arranged clamps, with clamps simultaneously rotatable by a collective operating mechanism with an operating handle and through rotation co-acting with the peripheral zones of corresponding non-round continuous holes in the door, which peripheral zones have for each clamp a contact surface inclining relative to the main plane of the door structure in the closed situation, which continuous holes have a form such that a clamp can pass therethrough;

wherein the door includes a second plate which is strengthened with at least one beam welded to said second plate and extending between two clamps situated on either side of the door;

the clamps are arranged symmetrically pairwise on rotation shafts;

the continuous holes in the door are correspondingly formed slotted holes; and each peripheral zone of a continuous hole in the door has two substantially symmetrically located, including clamp contact surfaces.

2. The door structure as claimed in claim 1, wherein the door is generally elongate, the hinge construction extends in a longitudinal direction and the at least one beam extends in a transverse direction.

3. The door structure as claimed in claim 1, wherein the second plate is substantially flat and the at least one beam has a U-shaped profile, which beam is welded substantially wholly to said second plate with the free end edges of the U-shaped profile.

4. The door structure as claimed in claim 1, wherein around the rotation shaft of each clamp is situated a filler piece which fits into the corresponding hole in the door.

5. The door structure as claimed in claim 1, wherein each continuous hole in the door is wholly enclosed by material.

6. The door structure as claimed in claim 1, wherein the clamps and associated holes are placed symmetrically.

7. The door structure as claimed in claim 1, wherein the door structure consists substantially of metal.

8. The door structure as claimed in claim 1, wherein the second plate consists of steel plate with a thickness of 3–10 mm.

9. The door structure as claimed in claim 1, wherein the at least one beam has a wall thickness of 2–8 mm and consists of steel having a high yield point.

10. The door structure as claimed in claim 1, further including a neoprene rubber sealing ring which seals the door relative to the first plate in a closed situation.

* * * * *